US008491107B2

(12) United States Patent
McFarland et al.

(10) Patent No.: US 8,491,107 B2
(45) Date of Patent: Jul. 23, 2013

(54) FLUID CONTAINER HAVING MIXING CHAMBERS FOR MICRO-FLUID APPLICATIONS

(75) Inventors: Neal D. McFarland, Versailles, KY (US); Gina M. Johns, Nicholasville, KY (US); Shirish Mulay, Lexington, KY (US); Robert Cornell, Lexington, KY (US); Nicholas Post, Lexington, KY (US); Kent Ubellacker, Georgetown, KY (US); Edmund James, III, Lexington, KY (US)

(73) Assignee: Funai Electric Co., Ltd. (JP)

( * ) Notice: Subject to any disclaimer, the term of this patent is extended or adjusted under 35 U.S.C. 154(b) by 174 days.

(21) Appl. No.: 12/948,122

(22) Filed: Nov. 17, 2010

(65) Prior Publication Data

US 2012/0105555 A1 May 3, 2012

Related U.S. Application Data

(60) Provisional application No. 61/408,065, filed on Oct. 29, 2010.

(51) Int. Cl.
*B41J 2/175* (2006.01)
*B41J 2/17* (2006.01)

(52) U.S. Cl.
USPC ..... 347/85; 347/84; 347/86

(58) Field of Classification Search
USPC ..... 347/84, 85, 86
See application file for complete search history.

(56) References Cited

U.S. PATENT DOCUMENTS

| | | | |
|---|---|---|---|
| 3,876,282 | A | 4/1975 | Schon |
| 6,312,113 | B1 | 11/2001 | Murad |
| 6,742,881 | B2 | 6/2004 | Kotaki |
| 6,817,705 | B1 | 11/2004 | Crockett |
| 7,618,133 | B2 | 11/2009 | Kubo |
| 7,735,984 | B2 | 6/2010 | Iijima |
| 2008/0062231 | A1 | 3/2008 | Kubo |
| 2010/0053280 | A1 | 3/2010 | Ohashi |

FOREIGN PATENT DOCUMENTS

| | | | |
|---|---|---|---|
| JP | 2001260377 | A | 8/2001 |
| JP | 2001260378 | A | 8/2001 |
| JP | 2001260379 | A | 8/2001 |
| JP | 2004216761 | A | 7/2004 |
| JP | 2005066520 | A | 3/2005 |
| JP | 2007230189 | A | 9/2007 |

*Primary Examiner* — Jannelle M Lebron
(74) *Attorney, Agent, or Firm* — Amster, Rothstein & Ebenstein LLP

(57) ABSTRACT

A consumable supply item for an imaging device holds an initial or refillable volume of pigmented ink. Its housing defines an interior and exterior. The interior retains the ink and an exit port supplies it to an imaging device. Users orient the housing to deplete the ink in a direction of gravity toward a bottom surface of the interior en route to the exit port. The ink passes through a mixing chamber having inlet ports arranged to restrict to multiple different heights the entrance of the volume of ink from the interior. As ink draws from various heights into the chamber, sediments in the pigment mix together. The design overcomes settling. It also avoids mechanical stirring and other complex mixing techniques. Further embodiments include chamber shapes, configuration of inlet ports, and construction of the supply item, to name a few.

18 Claims, 6 Drawing Sheets

FLUID CONTAINER HAVING MIXING CHAMBERS FOR MICRO-FLUID APPLICATIONS

This application claims priority and benefit of U.S. Provisional Patent Application No. 61/408,065, filed Oct. 29, 2010, entitled "Ink Container for Micro-Fluid Applications." The entirety of the provisional application is incorporated herein by reference as if set forth herein.

FIELD OF THE INVENTION

The present invention relates to micro-fluid applications, such as inkjet printing. More particularly, although not exclusively, it relates to supply item containers that overcome settling problems associated with pigmented ink. Mixing chambers facilitate certain designs.

BACKGROUND OF THE INVENTION

The art of printing images with micro-fluid technology is relatively well known. A permanent or semi-permanent ejection head has access to a local or remote supply of fluid. The fluid ejects from an ejection zone to a print media in a pattern of pixels corresponding to images being printed. According to application, the fluid has dye or pigment based ink. Dye ink is typically cheap and has a broad color gamut. Pigmented ink is generally more expensive, but has a longer archival print life and higher color stability. Over time, technology has improved the color gamut of pigmented ink such that users are no longer required to choose between the broad colors available with dye ink in lieu of the improved permanence of pigmented ink.

Far from offering a printing panacea, pigmented ink is known to have layers of differing concentrations. Sediments in a container settle downward over time leaving rich concentrations near a bottom, while leaner concentrations are left near a top. As a function of height in a container above a floor, FIG. 1A details how gravity turns an initial concentration 10 of a relatively uniform or homogeneous mixture of pigmented ink into a heavily layered mixture 12 upon the passage of time. With reference also to FIG. 1B, the carbon black concentration of pigment is predicted fairly accurately by applying either the Mason/Weaver equation to particle sedimentation or a numerical analysis using finite element modeling. In either, the highest percentages of carbon black appear in the lowest heights 14 of a fluid after only a few weeks. As concentration varies relative to particle size, particle density, and fluid density and viscosity of the ink, typical pigmented inks settle into a lowest layer 16 of very high pigment concentration near the floor of the container in a height of about 2-5 mm. Above this layer, the ink settles into nominal-like concentration 18. In a top layer 20, the ink has low pigment concentration and grows deeper in the container over time.

When printing, ink drawn from a floor of a settled container leads first to excessively densely printed colors and later to excessively lightly printed colors. The variations yield unacceptable visible defects. The former can also lead to clogging of ejection head nozzles as the largest particles accumulate together in micron-sized channels having fastidious fluid flow standards.

To overcome these problems, a number of solutions have been offered. Yet, none provide economic advantage or acceptable relief across all facets of design, manufacturing and use. For example, containers are known with mechanical stir bars or other agitating members that roil ink and mix sediments before and during use. While nominally effective, the approach causes expensive/complex manufacturing and necessitates motive force during use to set the agitating bodies into motion. In other designs, ink containers have fluid exit ports raised to a height measurably higher than a floor of the container. While such avoids supplying ink to an imaging device having too dense a concentration, it prevents full use of a container's contents as appreciable amounts of ink rest below the exit port on the lowermost surfaces of the container. Still other designs contemplate both mechanical agitating members and raised exit ports. This only compounds the problems of individual designs.

Accordingly, a need exists in the art to deliver imaging devices an entirety of pigmented ink in a container. The need extends not only to an economical solution but to delivering ink in such a manner that the concentration has uniform properties over the life of the container, independent of usage rate, temperature or other imaging device conditions. Additional benefits and alternatives are also sought when devising solutions.

SUMMARY OF THE INVENTION

The above-mentioned and other problems become solved with mixing chambers for containers in micro-fluid applications. A consumable supply item for an imaging device holds an initial or refillable volume of pigmented ink. Its housing defines an interior and exterior. The interior retains the ink and an exit port supplies it to an imaging device. Users orient the housing to deplete the ink in a direction of gravity toward a bottom surface of the interior where the mixing chamber resides. The chamber has inlet ports arranged to restrict to multiple different heights the entrance of the volume of ink from the interior. As ink draws into the chamber, sediments from different layers mix together. High-concentrated ink settled near a bottom of the container combines with less concentrated ink from above. It overcomes pigment settling during periods of inactivity. It improves conventional designs having mechanical stirring and other techniques. It limits entrainment of settled particles at the bottom of the container. It adds little cost yet provides substantial mixing of pigmented ink components. Further embodiments include chamber shapes, configuration of inlet ports, and construction of the supply item, to name a few.

These and other embodiments are set forth in the description below. Their advantages and features will be readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the features of the invention, methods and apparatus include mixing chambers for ink containers to overcome settling problems associated with pigmented ink.

Figure 1:
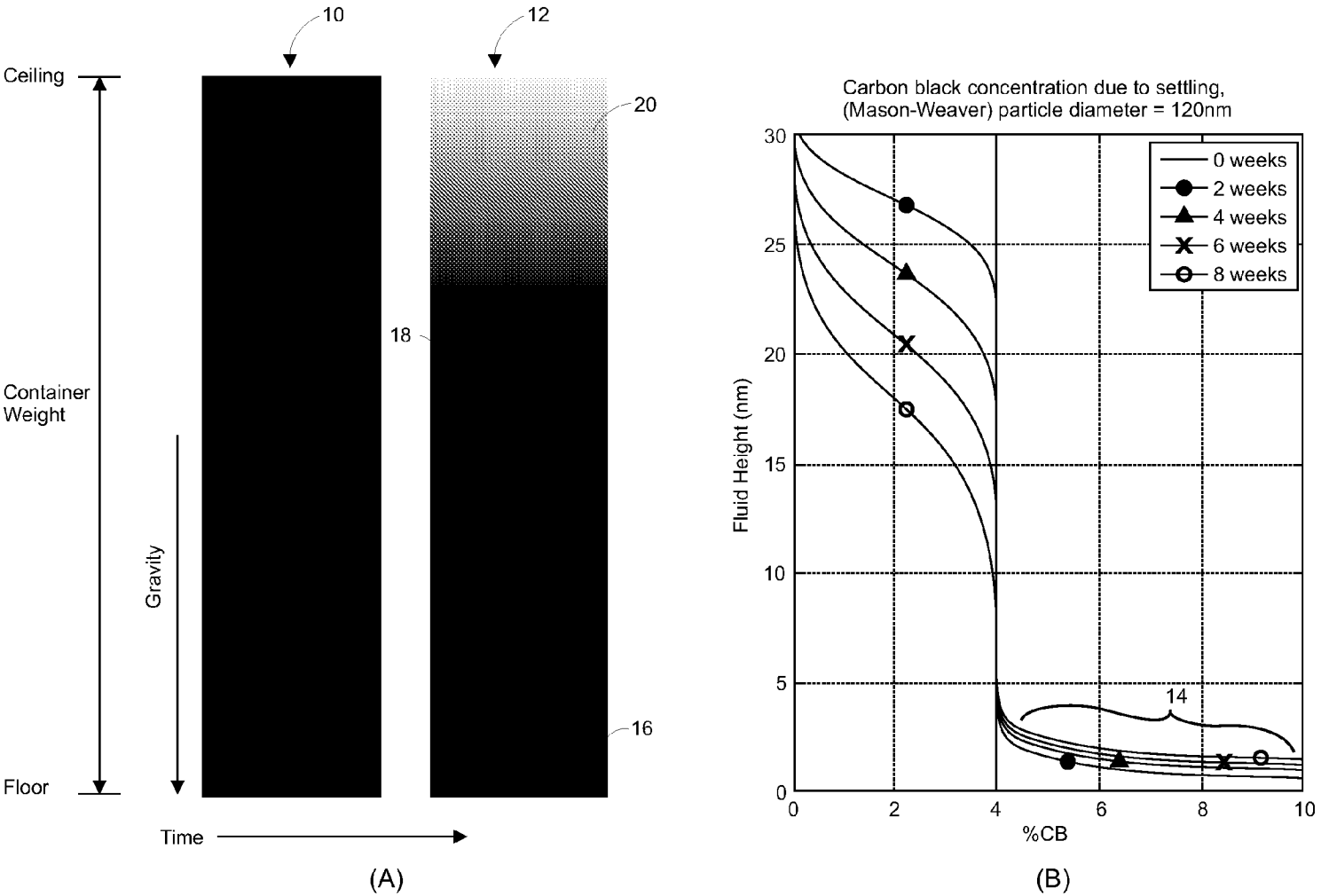
FIG.1 (Prior Art)
FIGS. 1A and 1B are graphs in accordance with the prior art showing settling of pigmented ink.
Figure 2A:
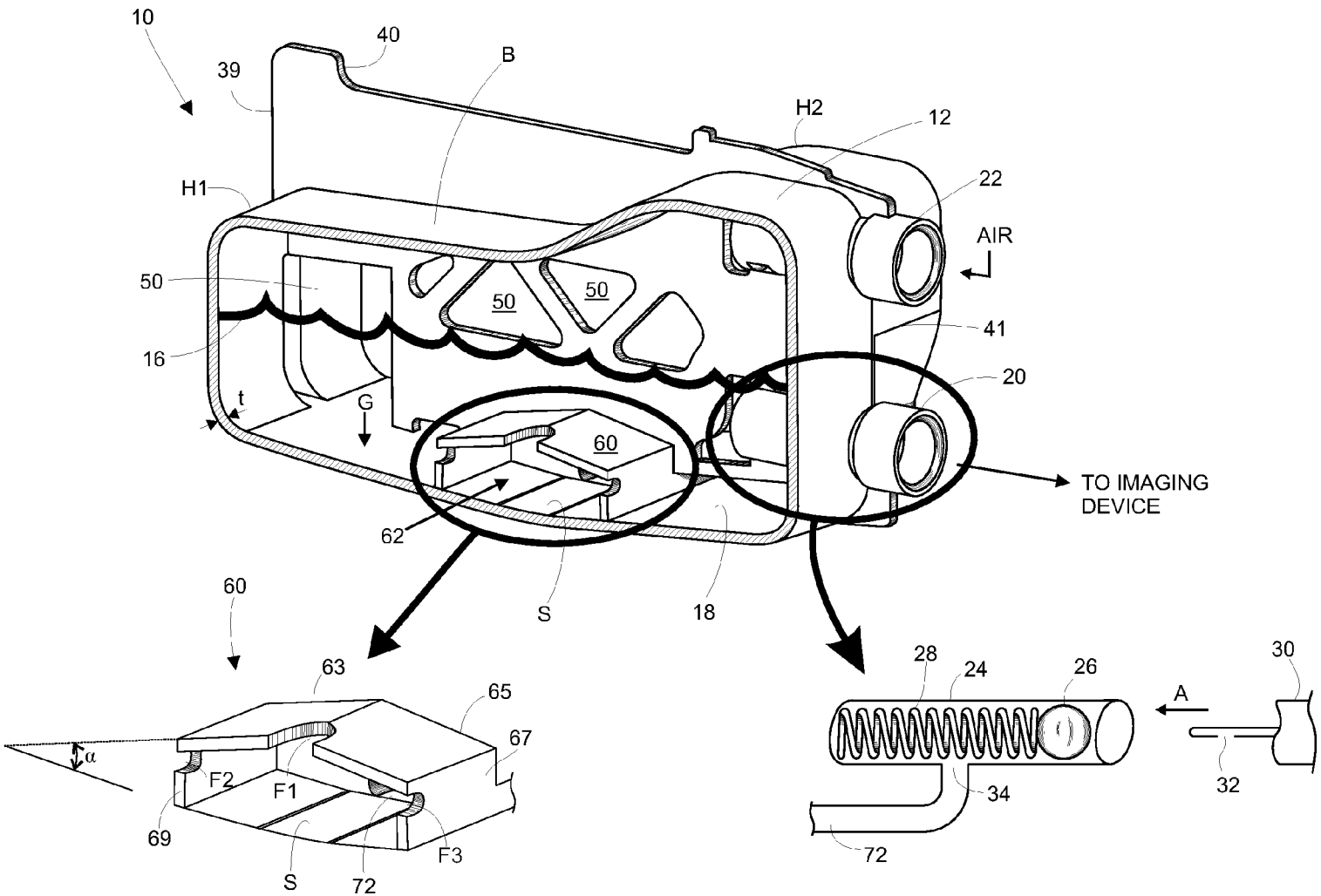
FIG. 2A is a perspective view in accordance with the present invention showing a container having a mixing chamber.
Figure 2B:
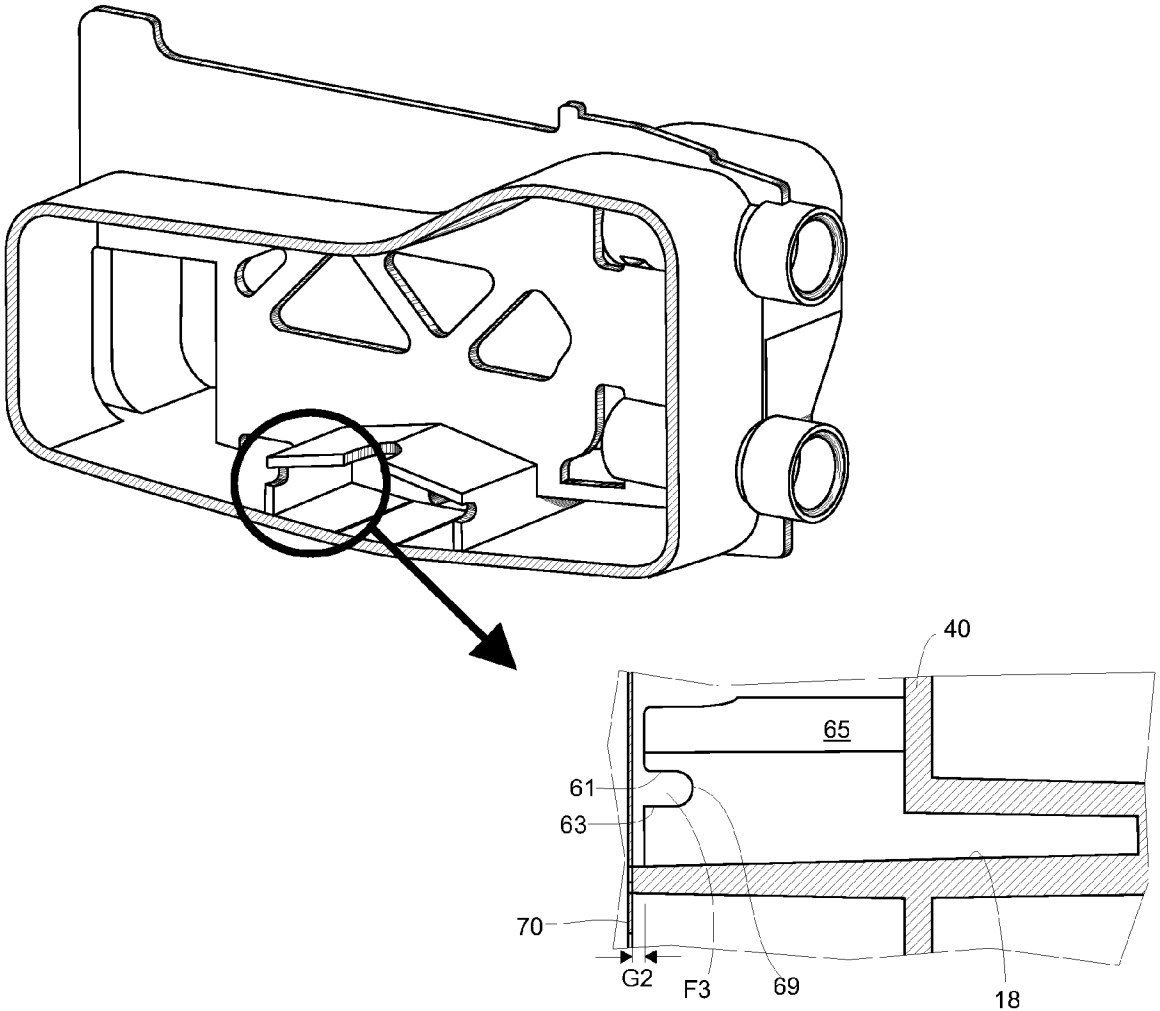
FIG. 2B is a repeat perspective view of FIG. 2A and a side diagrammatic view in accordance with the present invention showing a container having a mixing chamber.

With reference to FIGS. 2A and 2B, a supply item 10 for use in an imaging device includes a housing 12. The housing defines an interior 14 that contains an initial or refillable supply of ink 16. The ink can be any of a variety of aqueous inks, such as those based on dye or pigmented formulations. It also can typify varieties of color, such as cyan, magenta, yellow, black, etc. It can be used in many applications such as inkjet printing, medical imaging, forming circuit traces, etc.

During use, the volume of ink depletes downward toward a bottom surface 18 of the interior of the housing in a direction of gravity G. The bottom surface is generally flat or concaved upward to define a low point area or sump S from which the ink can be drawn. The ink flows out of the housing to the imaging device by way of an exit port 20. An air venting port 22 provides intake of ambient, recycled or other air to overcome backpressure that increases during imaging operations. The ports are any of a variety but typify cylindrical tubes 24 with an internal ball 26 and spring 28. They are mated with a septum needle 30 from the imaging device. The needle inserts into the port in the direction of the arrow A. It is pushed to overcome the bias of the spring and the ball slides backward. Upon sufficient insertion, openings 32, 34 in the port and needle are communicated so that a fluidic channel opens between the interior 14 of the housing and the needle. Fluid then exits port 20. Seals and septums, or the like, may find utility in the design to prevent leakage. Other fluid communication channels can also be used.

The housing is any of a variety of containers for holding ink. It can typify plastics, glass, metal, etc. It can be recyclable or not. It can contemplate simplicity or complexity. Techniques for production are varied, but blow molding, injection molding, etc. are common techniques. Welding, heat-staking, bonding, dies, etc. are also envisioned. The materials, construction, shipping, storage, use, etc. of the housing can also focus on criteria, such as costs, ease of manufacturing, durability, or a host of other items. The list is nearly indefinite.

The shape of the housing can vary widely. Implicating its shape are good engineering practices, including contemplation of a larger imaging context in which the housing will be used. In the design given, the housing is generally elongated from its back end 39 to its port end 41. The port end inserts forward into an imaging device, while the back end is acted upon by users for pushing. The shape also includes substantially symmetrical halves H1, H2. The halves are formed during a single manufacturing instance and reside on opposite sides of a central support 40. The support is thick to keep the structure from bowing in or out. The halves each define an endless boundary B of wall sections. The sections, formed together as one or fitted together from individual parts, define a thickness t of material in which the fluid 16 is stored on an interior. A plurality of openings 50 reside at various heights in the central support to allow flow of pigmented ink back and forth between each of the two halves. The openings are of any shape and size. They are sufficient in number along the longitudinal extent of the support to allow fluid communications between the halves H1, H2, but not too frequently disposed to sufficiently weaken the structural integrity of the support. A passageway 72 through the support leads the fluid to the exit port.

At 60, a mixing chamber resides above the sump S. It has a chamber interior 62 in fluid communication between the interior 14 of the housing and the fluid exit port 20. It communicates directly with the passageway 72. Ink is substantially mixed in the chamber and passed to the fluid exit port 20 for use in the imaging device. The mixture yields an optimal and continual concentration of pigment.

At least one continual wall or pluralities of wall sections define the size and shape of the mixing chamber. Pluralities of fluid inlet ports reside in the wall(s). They are arranged to restrict the passage of a volume of fluid from the interior of the housing into the chamber interior at multiple heights above the bottom surface of the interior. A first of the fluid inlet ports F1 is defined at an apex of the chamber. It is a topmost opening in a connecting wall defined by two inclined surfaces 63, 65 angling upward from two walls 67, 69 oriented upright from the bottom surface 18. The angle facilitates movement upward and exit at F1 of bubbles trapped in the chamber interior under the inclined surfaces. The angle $\alpha$ is any of a variety but ranges in certain embodiments from about nine to about thirteen degrees from horizontal. Preferably, the angle is about ten to eleven degrees. In other embodiments, the connecting wall has no inclinations and is relatively horizontal across the bottom surface between the upright walls.

In either design, the thickness of the walls is made variable. They are thick enough to provide structural rigidity over the life of a container, but not so thick they consume valuable space in the container that could be otherwise occupied by ink. In one design, the walls are 1-4 mm thick. Also, each wall is about the same thickness as every other wall and about the same thickness t as the bottom surface 18.

In each of the upright walls, second and third fluid inlet ports F2, F3 are found. They are located above the bottom surface 18 at a height of at least 2.0-3.0 mm. The shape of the inlet ports are roughly the same as the topmost inlet port. They define substantially elongated walls 61, 63 connected together at a distal end by a circular wall section 65. At a proximate end, each of the ports defines an opening that fronts a sealing film 70 (inset). The film is staked to the boundary B of the container to effectively seal the fluid in the interior of the housing, but is otherwise gapped G2 from the proximate openings of the inlet ports F1-F3. The film is also gapped from the wall(s) defining the mixing chamber. In this way, small amounts of ink can enter the chamber between the wall and film. It avoids stranding ink at the bottom of the chamber that would exist otherwise as the fluid in the tank depletes beneath the lowermost inlet ports F2, F3.

At a back of the mixing chamber, the wall(s) of the chamber abut the central support 40. The further away the inlet ports reside from the support, the more useful they are in drawing ink into the chamber interior. In other embodiments, there could be inlet ports residing at differing distances from each of the sealing film and central support. There is also no requirement that each wall support a fluid inlet port, that each port has a specified size or shape, or that only one inlet port exists in a given wall. Instead, the inventors have noticed that a preferred construction is to provide a ratio of inlet port cross-sectional areas so that the volume of fluid being allowed to pass into the mixing chamber is greater for the higher inlet ports as compared to the lower inlet ports. In this instance, the inlet port F1 on the connecting wall is greater than the remaining two inlet ports F2, F3 on the upright walls. The ratio of cross-sectional areas is about one (1) to about five (5). An optimal ratio exists at about two and one half (2.5). The greater the ratio, the more that fluid is drawn from a top of the mixing chamber where the pigment in the container is more diluted than from lower where the pigment is more concentrated (and vice versa). The design also yields slow consumption of the ink in the lower layers of the container near a bottom surface 18 along with faster consumption of higher layers of ink having a more nominal pigment concentration. In the chamber, the diluted ink and the concentrated ink mix together for delivery to the imaging device.

Figure 3:
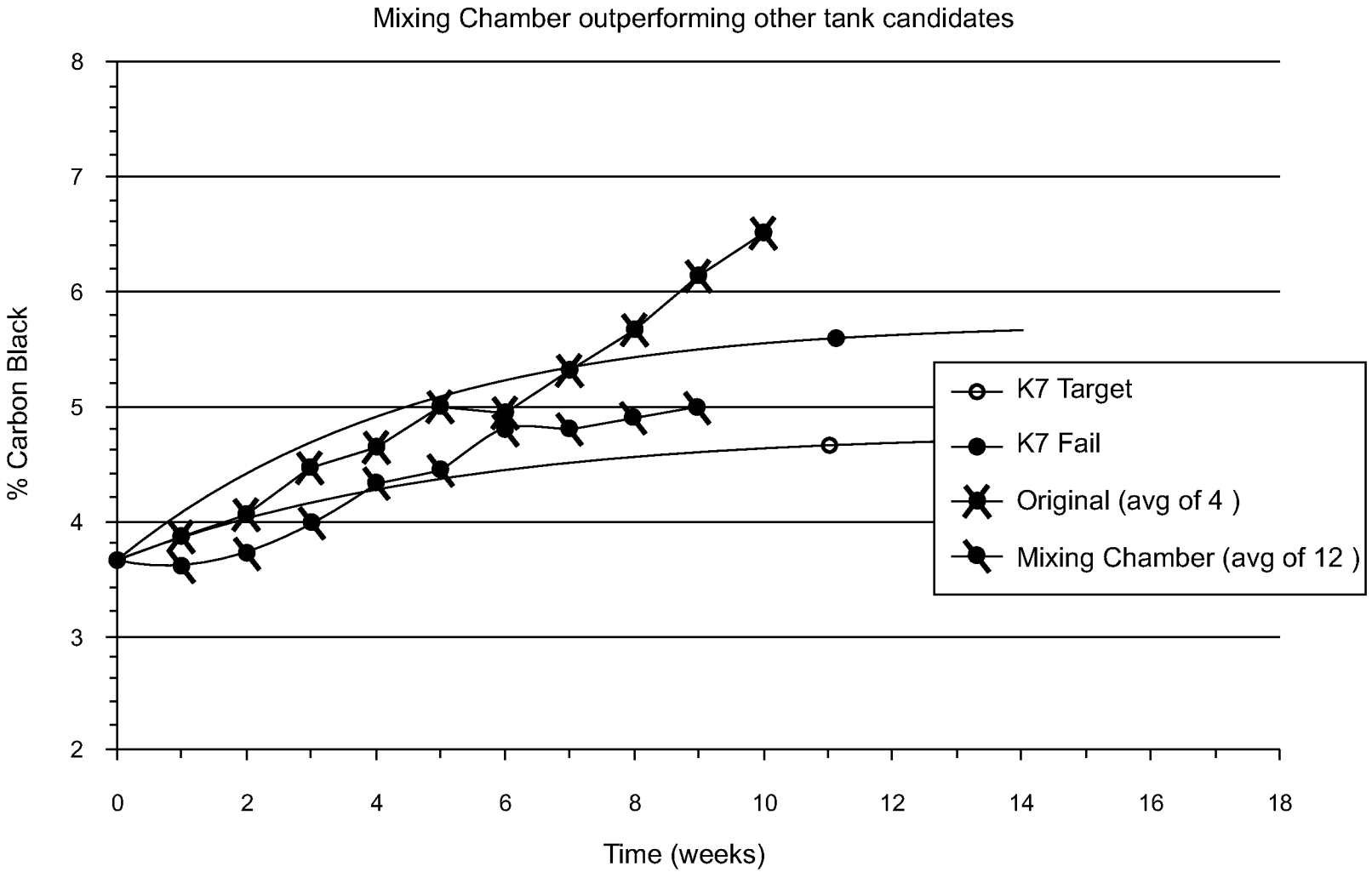
FIGS. 3 and 4 are graphs showing settling of ink using a mixing chamber of the invention.

With reference to FIG. 3, modeling has shown the foregoing design improves consistency of pigment concentration for delivery to an imaging device. Ink samples for the mixing chamber embodiments of FIGS. 2A and 2B (alternatively known as "snoopy," "ERT," "SERT," or "doghouse" in the priority provisional application) have been prospectively taken relative to the simple case (original) of a container having a single inlet at its bottom without a mixing chamber. Relative also to a target (K7 Target) and unacceptable levels (K7 Fail), the response of carbon black over time for the instant invention is much closer to the target than is the original. It also never crosses over into regions of failure, like the original does. (The K7 Target sets the goal of keeping down the amplitude of the increase in percent carbon black as time progresses.)

Figure 4:
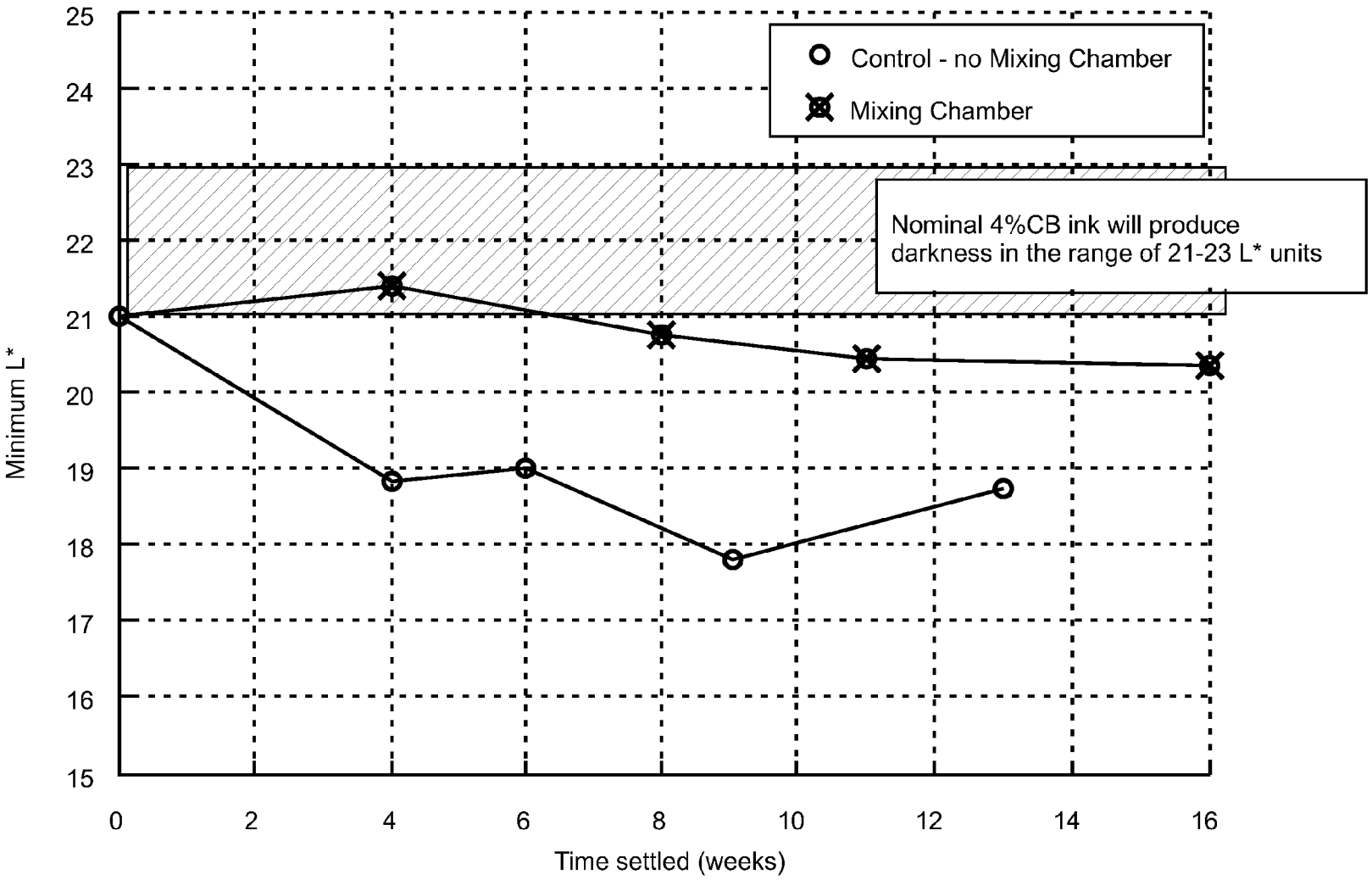

With reference to FIG. 4, minimum luminance (L*) for a container of the invention ("Mixing Chamber") relative to a control container (having no mixing chamber) is plotted over time. Print samples evaluated for luminance from containers are known to reach a characteristic dip (minimum luminance value) upon settled ink reaching a print media. A goal exists, therefore, to minimize that dip when making consistent ink concentrations. Also, in an unsettled container of pigmented ink, a nominal luminance L* value corresponds to about 21 to 23 for 4% carbon black (CB). An L* lower than this range indicates that the ink has a higher concentration of pigment, while a higher L* value indicates a lower concentration of pigment. In the Figure, the container having a mixing chamber maintains its minimum L* closer to 21 over 0-16 weeks than does the control container. It implies an improved consistency of pigment concentration.

Figure 5:
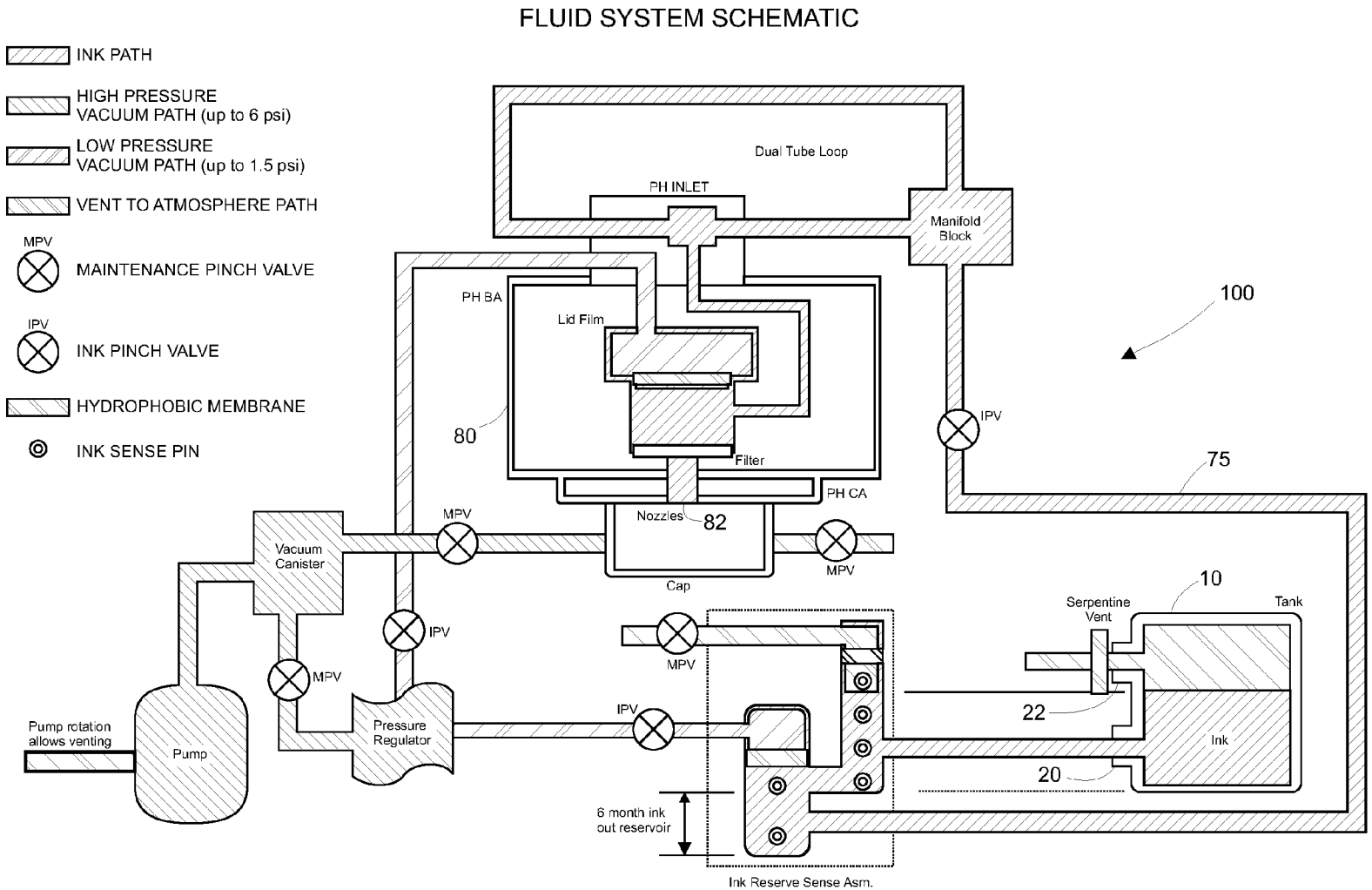
FIG. 5 is a schematic view of an ink container deployed in an imaging device.

With reference to FIG. 5, a schematic view is given of an ink container 10 deployed in an imaging device 100. Fluid paths extend from the fluid exit port 20 and air vent port 22. The fluid is delivered in a channel 75 to a printhead 80 (PH) for ejection from nozzles 82 for imaging media. The printhead is of the permanent or semi-permanent type. The supply item container is replaced numerous times over the life of the imaging device. At port 22, the container 10 is vented to atmosphere.

Relatively apparent advantages of the many embodiments include, but are not limited to: (1) delivering essentially all the fluid in a container to an imaging device; (2) delivering the fluid in such a manner that the pigment concentration of the ink exiting the container has uniform properties over the lifetime of the container; (3) delivering uniformly pigmented ink, independent of usage rate, temperature or other typical conditions in an imaging environment; (4) providing a mixing chamber at little cost to the container design; and (5) providing passive mixing of pigmented ink without needing mechanical stir bars or other complex mechanisms.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. All modifications and variations are contemplated within the scope of the invention as determined by the appended claims. Relatively apparent modifications include combining one or more features of various embodiments with features of other embodiments.

The invention claimed is:

1. A container to hold an initial or refillable volume of fluid, comprising:

a housing defining a fluid exit port and an interior to retain the volume of fluid, the interior oriented during use to deplete the volume of fluid in a direction of gravity toward a bottom surface of the interior; and a mixing chamber having a chamber interior in fluid communication between the interior of the housing and the fluid exit port, the mixing chamber having fluid inlet ports arranged to pass the volume of fluid from the interior of the housing into the chamber interior at multiple heights above the bottom surface of the interior, wherein a topmost fluid inlet port allows direct passage of fluid from the interior into the chamber along a path in the direction of gravity upon proper orientation of the housing during use.

2. The container of claim 1, further including a plurality of walls defining the mixing chamber, each of the fluid inlet ports being located in a different one of the walls.

3. The container of claim 1, wherein a ratio of cross-sectional area of the topmost fluid inlet port to a remainder of the fluid inlet ports is about one (1) to about five (5).

4. A consumable supply item for an imaging device to hold an initial or refillable volume of ink, comprising:

a housing defining an interior to retain the volume of ink and an ink exit port for placement into fluid communication with the imaging device, the interior oriented during use to deplete the volume of ink in a direction of gravity toward a bottom surface of the interior en route to the ink exit port; and a mixing chamber in fluid communication between the interior of the housing and the ink exit port, the mixing chamber defined by at least one wall having fluid inlet ports arranged to pass the volume of ink from the interior of the housing to the fluid exit port at multiple heights above the bottom surface of the interior to mix the ink, wherein a topmost fluid inlet port allows direct passage of fluid from the interior into the chamber along a path in the direction of gravity upon proper orientation of the housing during use.

5. The container of claim 4, wherein the at least one wall of the mixing chamber connects to the bottom surface but does not otherwise connect to an exterior of the housing.

6. The supply item of claim 4, the mixing chamber further including two walls oriented upright from the bottom surface of the interior.

7. The container of claim 6, wherein at least one of the fluid inlet ports resides in one of the two walls oriented upright at a height of at least 2.0 mm above the bottom surface of the interior.

8. The container of claim 6, further including a connecting wall above the bottom surface of the interior between the two walls oriented upright.

9. The container of claim 8, wherein the connecting wall defines two inclined surfaces angling upward toward an apex from the two walls oriented upright.

10. The container of claim 9, wherein each of the two inclined surfaces connect to a respective one of the two walls oriented upright at an angle of about 9 to about 13 degrees from horizontal.

11. The container of claim 9, wherein the topmost fluid inlet port resides at the apex of the connecting wall.

12. A consumable supply item for an imaging device to hold an initial or refillable volume of pigmented ink, comprising:

a housing having an interior and exterior, the interior to retain the volume of pigmented ink and an ink exit port for placement into fluid communication with the imaging device for the pigmented ink to be supplied for imaging operations, the interior oriented during use to deplete the volume of ink in a direction of gravity toward a bottom surface of the interior en route to the ink exit port; and a mixing chamber in fluid communication between the interior of the housing and the ink exit port, the mixing chamber defined by walls having fluid inlet ports arranged to pass the volume of ink from the interior of the housing to the fluid exit port at multiple heights above the bottom surface of the interior to mix the pigmented ink, wherein the housing remains stationary during use in the imaging device away from a permanent or semi-permanent printhead having nozzles for imaging and a topmost fluid inlet port of the mixing chamber allows direct passage of fluid from the interior into the chamber along a path in the direction of gravity upon proper orientation of the housing.

13. The supply item of claim 12, wherein the housing has two substantially symmetrical halves configured adjacent a central support.

14. The supply item of claim 13, wherein the central support has a plurality of openings at various heights above the bottom surface to flow pigmented ink between each of the two substantially symmetrical halves.

15. The supply item of claim 13, wherein a back of the mixing chamber abuts the central support so pigmented ink can only enter the fluid inlet ports on a side of the mixing chamber away from the central support.

16. The supply item of claim 15, wherein a passageway through the central support connects the back of the mixing chamber to the ink exit port.

17. The supply item of claim 13, wherein the ink exit port connects to the central support.

18. The supply item of claim 17, further including an air venting port connected to the central support above the ink exit port as oriented during use.

* * * * *